US005191979A

United States Patent [19]

Nemeroff

[11] Patent Number: 5,191,979

[45] Date of Patent: Mar. 9, 1993

[54] INDIVIDUAL DISPOSABLE DRINKING CUPS AND METHOD

[76] Inventor: Allan Nemeroff, 124N Beaver Hill, 309 Florence, Jenkintown, Pa. 19046

[21] Appl. No.: 694,108

[22] Filed: Jan. 23, 1985

[51] Int. Cl.[5] ..... B65D 3/00; B65D 79/00; B65B 5/00; G09F 19/00

[52] U.S. Cl. ..... 206/459.5; 40/324; 53/428; 53/447; 116/201; 229/1.5 B; 283/70

[58] Field of Search ..... 206/459, 217, 806, 820, 206/447, 459.5; 229/1.5 B; 40/324; 221/307; 283/70; 116/201; 53/428, 447

[56] References Cited

U.S. PATENT DOCUMENTS

| | | | |
|---|---|---|---|
| 496,131 | 4/1893 | Peirce . | |
| 1,770,118 | 7/1930 | Williams | 206/217 |
| 2,804,236 | 8/1957 | Plazze | 206/806 |
| 2,818,168 | 12/1957 | Tobey et al. | 206/447 |
| 2,861,717 | 11/1958 | Vines | 221/307 |
| 2,908,985 | 10/1959 | Hartman | 40/2 |
| 3,182,791 | 5/1965 | Jenner | 206/459 |
| 3,306,437 | 2/1967 | Nelson | 206/459 |
| 3,514,887 | 6/1970 | Jacobs | 40/324 |
| 3,574,957 | 4/1971 | Bello-Bridick | 35/76 |
| 3,612,321 | 10/1971 | Larson | 128/760 |
| 3,627,858 | 12/1971 | Parts et al. | 40/324 |
| 3,827,620 | 8/1974 | Ludder | 206/459 |
| 3,908,877 | 9/1975 | Kosisky | 206/459 |
| 4,114,605 | 9/1978 | McGhee et al. | 128/760 |
| 4,171,085 | 10/1979 | Doty | 229/1.5 |
| 4,235,459 | 11/1980 | Callahan | 283/7 |
| 4,287,824 | 9/1981 | Boyle | 101/172 |
| 4,518,639 | 5/1985 | Phillips | 206/459 |
| 4,573,954 | 3/1986 | Berger et al. | 400/103 |

*Primary Examiner*—Allan W. Shoap
*Attorney, Agent, or Firm*—Kenyon & Kenyon

[57] ABSTRACT

A set of drinking cups is provided with a series of individual identifying indicia, which serve to distinguish one cup of the set from another. The indicia may be printed or otherwise applied to the cups. The indicia may also be hidden as the cups are supplied, to be revealed when a mask is removed therefrom.

4 Claims, 2 Drawing Sheets

INDIVIDUAL DISPOSABLE DRINKING CUPS AND METHOD

BACKGROUND OF THE INVENTION

This invention relates to apparatus and a method for individualizing disposable drinking cups, to distinguish the cup of one user from that of another. Disposable drinking cups are extremely popular for the convenience they offer in situations in which large numbers of people are served. As is well known, disposable cups are offered by manufacturers in plastic or paper, and may be had in plain, unadorned form, in colors, or with decorative designs. Cups are typically purchased in bulk, and in the usual case, all of the cups in a given package are similar, if not identical, in appearance. This leads to situations in which the drinks of individual users, when put down momentarily, cannot be distinguished from one another. Thus, individuals often cannot identify their own drinks and are faced with the choice of drinking from a cup which may have been used by another, or abandoning what may indeed may be their own drink.

Where confusion occurs of one drink for another, the results are unsanitary, and potentially injurious to health. On the other hand, when one unneccessarily abandons a cup because it cannot positively be identified, the result is wasteful, and uneconomical.

In U.S. Pat. No. 3,908,877, to Kosisky, it was proposed to provide a circular tray having circumferentially spaced openings, marked with the names of individual users. Cups, also bearing the names of the individual users, are associated with the openings. Such an arrangement permits the identification of cups and drinks, but in order for the disclosed technique to work, the cups must be returned to the tray.

The present invention facilitates positive identification of individual cups, without the need, however, for any external apparatus such as the tray of the above-mentioned patent.

Thus, it is a general object of the present invention to provide for individualized disposable drinking cups. It is another object to provide a relatively inexpensive and easily effectuated system for individualizing disposable drinking cups, and avoiding the problem of confusion as between drinks of large numbers of persons at an event. Still another object is to provide a method for marking and distinguishing cups, one from the other.

Other objects will appear hereinafter.

SUMMARY OF THE INVENTION

The foregoing and other objects of the invention are achieved, in a presently preferred form of the apparatus, by providing at the point of sale a stack of cups, each bearing a unique indicium which sets that cup apart from the others. In one preferred form of the invention, the indicium may be a sequence of numbers, whereby individual users are provided with numbers different from those of any other user. In another embodiment of the invention, which adds a certain amusement value to its usage, each of the cups may be provided with a "peel-off" section, which when removed reveals an indicium (numbers, letters or a design), hidden behind the "peel-off" section.

In its method aspect, the invention comprises the steps of providing a stack of individual cups, to which there are, applied, individual identifying indicia, the indicia serving to distinguish the cups one from the other. The indicia may be pre-printed or otherwise applied to the cups.

There are seen in the drawings, forms of the invention which are presently preferred (and which represent the best mode contemplated for carrying the invention into effect), but it should be understood that the invention is not limited to the precise arrangements and instrumentalities shown or described herein.

DETAILED DESCRIPTION

Figure 1:
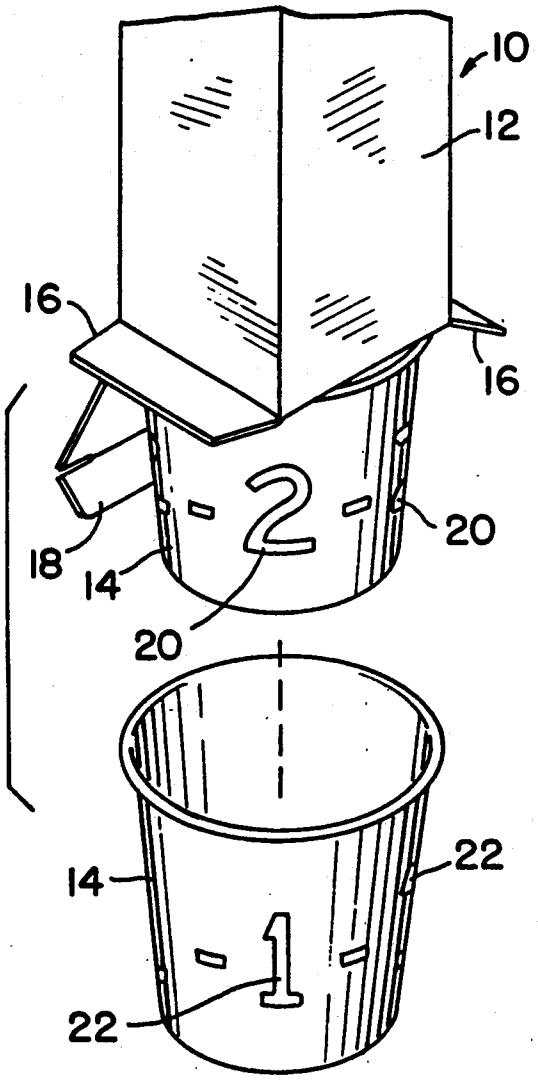
FIG. 1 is a perspective view, showing two cups in a numbered sequence, as they would be removed in accordance with this invention from a container in which they are stored or sold.

Referring now to the drawings in detail, wherein like reference numerals indicate like elements, there is seen in FIG. 1 apparatus designated generally by the reference numeral 10.

The apparatus 10 comprises a container 12 or a stacked set or series of drinking cups 14. The container 12 may be a conventional four-sided cardboard box, or any other rigid or flexible or elongated sleeve-like structure. The drinking cups 14, nested within each other, are received in the container 12, and may be removed from the container 12 upon opening of one of its ends.

End flaps 16 and 18 provide a closure for the end of the illustrated container 10.

The cups 14 carry individual identifying indicia, such as, in FIG. 1, numerical indicia 20 and 22. The indicia may appear on the cups at any desired number of times or places.

The indicia 20 and 22 are exemplary of other kinds of indicia which may be applied to the cups 14 supplied in the container 12. Where numerical indicia are used, the indicia for the respective cups are ideally and preferably a sequential series (i.e., "1, 2, 3, etc."), without repetition. Thus, each of the cups 14 has its own unique indicium which serves to distinguish it from every other cup 14 in the container 12. It should thus be apparent that a user of a cup 14 may, upon making a mental note of the indicium 18, 20, etc. which appears on his or her own cup, readily distinguish that cup from that of any other user.

In conventional practice, the cups 14 are made of either paper-like material, such as cardboard, or molded plastic. When the cups are of paper-like material, the indicia 20, 22, etc. may be printed on the cups during their manufacture. When the cups are plastic, the indicia 20, 22, etc. may advantageously be defined by roughened or etched areas, which stand out in visual contrast to non-affected material surrounding them.

Figure 2:
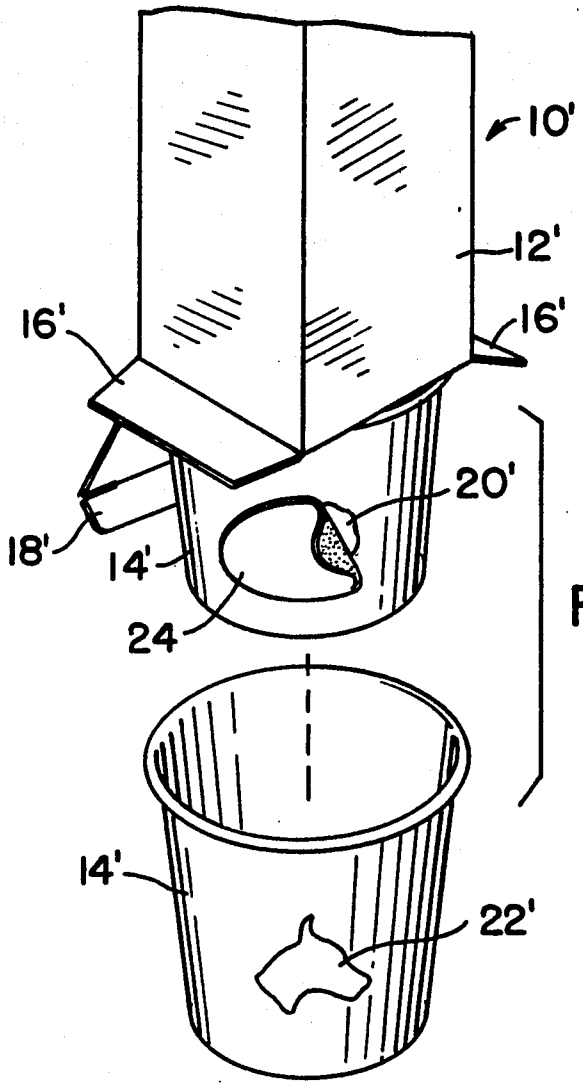
FIG. 2 is a perspective view, similar to FIG. 1, showing an arrangement whereby an identifying indicium, in this case, a pictorial representation, is hidden by a peel-off mask or panel.

Referring now to FIG. 2, there is seen an alternative form of the invention in which elements corresponding to those previously described are designated by like, primed (') reference numerals. Referring to FIG. 2, the cups 14' have applied to them, by printing or other suitable means, identifying indicia 20', 22', etc. In the case of the cups 14' shown in FIG. 2, the indicia, rather than being numerical, are pictorial representations of recognizable objects or designs. Again, however, the design associated with each individual cup 14' is unique, so that cups 14' in a given set can be distinguished one from the other.

In the embodiment shown in FIG. 2, prior to dispensing of the cups for usage, the indicia 20', 22', etc. are, covered by removable adhesively backed masking panels. In FIG. 2, the cup 14' which is illustrated in association with the container 12' has its masking panel 24 partly removed. In the case of the other cup 14', the masking panel which formerly covered the identifying indicium 22' has been fully removed to reveal the indicium 22' beneath it.

Figure 3:
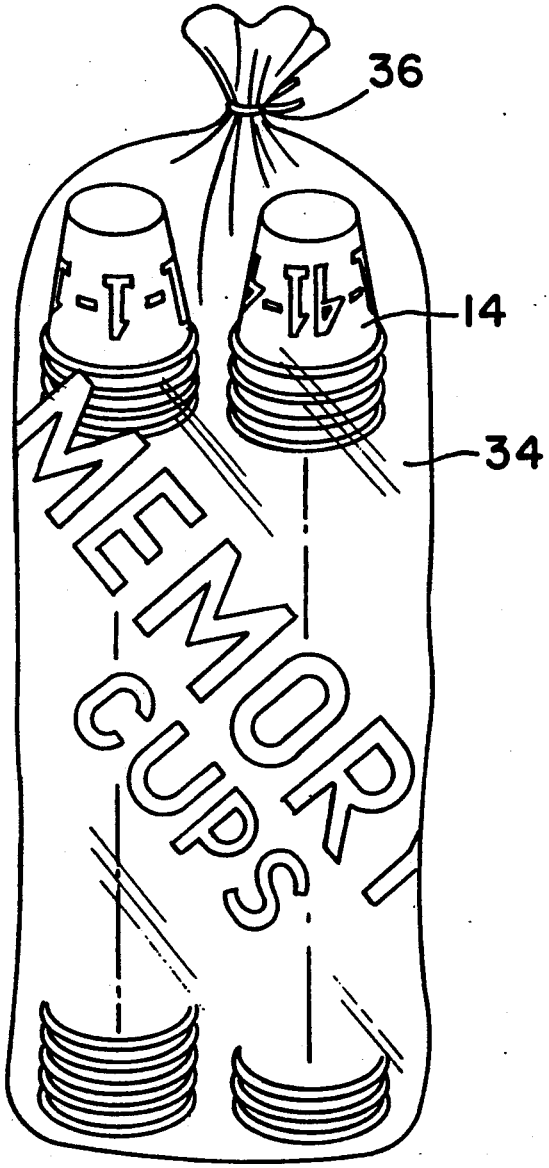
FIG. 3 illustrates one presently preferred form of packaging, in which numbered cups are provided in stacked form in a transparent and flexible plastic sleeve.

Referring to FIG. 3, cups, such as the cups 14 or others, may be sold in stacks, in a container which takes the form of a transparent flexible sleeve-like bag 26 or the like. The bag 26 may conventionally be provided with a tie 28. As is the case of the above-described packaging, the cups may be removed from the bag 26 in sequence, and may readily be identified for reuse by the indicia they bear.

It should be understood that the present invention may be embodied in other specific forms without departing from its spirit or essential attributes. Accordingly, reference should be made to the appended claims, rather than the foregoing specification, for an indication of the scope of the invention.

I claim:

1. Drinking cup identification apparatus comprising an elongated container, a set of drinking cups comprising a plurality of cups nestably received in said container and sequentially removable therefrom, and individual identifying indicia associated with each of said cups so as to facilitate visual discrimination of one cup from the others of said set, said indicia including a visually discernible identifying symbol attached to said cup, said identifying symbol being different from the symbols of the other cups in said set so as to distinguish the cups in said set from one another, said indicia being affixed to said cups in a preselected order during manufacture so that said cups, when removed from said container, carry said indicia, and said cups being received in said container in said preselected order.

2. A method of distinguishing disposable drinking cups one from another, comprising the steps of: providing a set comprising a plurality of drinking cups and applying to the cups of said set individual identifying indicia different from the indicia of the other cups of the set so as to facilitate visual discrimination of said cups one from the other, said step of supplying individual indicia to said cups consisting of selecting individual indicia to be associated with individual cups of said set and affixing said indicia to said cups in a preselected order during manufacture of said cups, and the further step of placing said cups in a container in said preselected order.

3. A method of distinguishing disposable drinking cups one from another, comprising the steps of: providing a set comprising a plurality of drinking cups and applying to the cups of said set individual identifying indicia different from the indicia of the other cups of the set so as to facilitate visual discrimination of said cups one from the other, said step of applying identifying indicia to said cups consisting of selecting individual indicia to be associated with individual cups of said set, affixing said indicia to said cups during manufacture of said cups, and the further step of placing said cups in a container as a set in a sequential order, said step of selecting individual indicia comprising selection of numerical indicia which relate to said sequential order.

4. A method in accordance with claim 3, and the further step of applying to said cups a mask for said indicia, whereby selective removal of the mask reveals said indicia.

* * * * *